US008858728B2

(12) United States Patent
Heisele et al.

(10) Patent No.: US 8,858,728 B2
(45) Date of Patent: Oct. 14, 2014

(54) WATER-CONDUCTING HOUSEHOLD APPLIANCE, IN PARTICULAR DISHWASHER OR WASHING MACHINE

(75) Inventors: Bernd Heisele, Sontheim (DE); Helmut Jerg, Giengen (DE); Roland Rieger, Rainau (DE); Michael Georg Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 842 days.

(21) Appl. No.: 13/054,795

(22) PCT Filed: Jul. 15, 2009

(86) PCT No.: PCT/EP2009/059028

§ 371 (c)(1),
(2), (4) Date: Jan. 19, 2011

(87) PCT Pub. No.: WO2010/010015

PCT Pub. Date: Jan. 28, 2010

(65) Prior Publication Data

US 2011/0126869 A1 Jun. 2, 2011

(30) Foreign Application Priority Data

Jul. 23, 2008 (DE) ..... 10 2008 040 647

(51) Int. Cl.

| | |
|---|---|
| ***B08B 3/00*** | (2006.01) |
| ***A47L 15/46*** | (2006.01) |
| ***D06F 39/00*** | (2006.01) |
| ***A47L 15/00*** | (2006.01) |
| ***D06F 33/02*** | (2006.01) |
| ***D06F 35/00*** | (2006.01) |
| *A47L 15/48* | (2006.01) |

(52) U.S. Cl.

CPC ..... *D06F 39/00* (2013.01); *A47L 15/46* (2013.01); *A47L 2401/12* (2013.01); *A47L 15/0057* (2013.01); *A47L 2401/22* (2013.01); *A47L 2401/34* (2013.01); *A47L 2501/34* (2013.01); *A47L 15/0047* (2013.01); *A47L 15/481* (2013.01); *A47L 2601/02* (2013.01); *D06F 33/02* (2013.01); *A47L 15/0015* (2013.01); *D06F 35/005* (2013.01); *A47L 2401/04* (2013.01)

USPC ..... 134/56 D; 134/57 D

(58) Field of Classification Search

None

See application file for complete search history.

(56) References Cited

U.S. PATENT DOCUMENTS

| | | | |
|---|---|---|---|
| 1,770,556 | A | 7/1930 | Stoddard et al. |
| 5,264,043 | A | 11/1993 | Milocco |

(Continued)

FOREIGN PATENT DOCUMENTS

| | | | |
|---|---|---|---|
| CH | 692897 | A5 | 12/2002 |
| CN | 1183943 | A | 6/1998 |

(Continued)

OTHER PUBLICATIONS

National Search Report CN 200980128166.9.

(Continued)

*Primary Examiner* — Jason Ko

(74) *Attorney, Agent, or Firm* — James E. Howard; Andre Pallapies

(57) ABSTRACT

A water-conducting household appliance has a washing container and is configured to carry out at least one wash program. A special cleaning program for cleaning the washing container is carried out when there is a start signal.

34 Claims, 4 Drawing Sheets

(56) References Cited

U.S. PATENT DOCUMENTS

| | | | | |
|---|---|---|---|---|
| 5,960,804 | A | 10/1999 | Cooper et al. | |
| 6,432,216 | B1 * | 8/2002 | Thies | 134/18 |
| 2002/0096192 | A1 | 7/2002 | Reichold | |
| 2006/0278257 | A1 | 12/2006 | Jerg et al. | |
| 2007/0094811 | A1 | 5/2007 | Sechelmann | |
| 2007/0274856 | A1 | 11/2007 | Kwon | |
| 2007/0295370 | A1 | 12/2007 | Jerg et al. | |
| 2007/0295373 | A1 | 12/2007 | Jerg et al. | |
| 2008/0092931 | A1 | 4/2008 | Karaaslan | |
| 2008/0308127 | A1 | 12/2008 | Padtberg et al. | |

FOREIGN PATENT DOCUMENTS

| | | | |
|---|---|---|---|
| CN | 1903115 | A | 1/2007 |
| DE | 19651347 | A1 | 6/1998 |
| DE | 69320380 | T3 | 5/2006 |
| DE | 102005004089 | A1 | 6/2006 |
| DK | WO9720493 | A1 | 6/1997 |
| EP | 0269917 | A2 | 6/1988 |
| EP | 0911438 | A1 | 4/1999 |
| EP | WO2008077970 | A1 | 7/2008 |
| JP | 2001346747 | A | 12/2001 |
| WO | 2007138420 | A3 | 12/2007 |
| WO | 2008077970 | A1 | 7/2008 |

OTHER PUBLICATIONS

Report of Examination CN 200980128166.9.

Report of Examination Including National Search Report CN 200980128230.3 dated Nov. 30, 2012.

* cited by examiner

WATER-CONDUCTING HOUSEHOLD APPLIANCE, IN PARTICULAR DISHWASHER OR WASHING MACHINE

BACKGROUND OF THE INVENTION

The invention relates to a water-conducting household appliance, in particular a dishwasher or washing machine.

A reduction in energy consumption is very important for water-conducting household appliances. Such an energy reduction can be achieved, for instance, by means of reduced process temperatures.

For example, a generic dishwasher has a control device in which at least one wash program, especially one at reduced process temperatures, for example a low-temperature program operating below 50° C., is stored. The low-temperature program is activated by the user by means of manual operation of a selector element. By means of the low-temperature program, the control device carries out a wash cycle or a rinsing cycle to clean the items to be washed.

In particular, the continuous use of low-temperature programs, such as a so-called gentle wash or a glass program, during which maximum temperatures of approx. 50° C. are achieved, results in greasy films of dirt collecting in the interior of the washing container. To remove such greasy films of dirt the user must use a special machine cleaner. For this the dishwasher must be operated without crockery at a temperature of least 65° C. Alternatively, from time to time the customer can independently use a high-temperature program, e.g. a 65° C. or intensive 70° C. program.

In both cases the cleaning of the device is therefore at the user's discretion. If the device is cleaned too frequently, energy consumption rises. In contrast, if the device is not cleaned often enough, the result is impaired cleaning of the items to be washed.

BRIEF SUMMARY OF THE INVENTION

The object of the invention is to provide a water-conducting household appliance, in particular a dishwasher or washing machine, with which a perfect cleaning result can be lastingly achieved with the least possible expenditure of energy.

The invention is based on a water-conducting household appliance, in particular a dishwasher or washing machine, designed to carry out at least one wash program, especially a low-temperature program. The at least one wash program may have a plurality of program steps, such as e.g. prewashing, cleaning, intermediate washing, rinsing and drying, which are performed consecutively to clean and dry items to be washed. To perform the program steps a control device can be provided in which the individual wash programs are stored.

According to the invention, a special cleaning program for cleaning the washing container, particularly by applying washing liquid thereto, is carried out when there is a start signal. The start signal therefore activates the special cleaning program inside the appliance without the need for a decision by the user. The special cleaning program can therefore always operate if there are actual or expected deposits of dirt in the hydraulic system of the water-conducting household appliance. To clean the washing container, which also includes the sump arranged in the base area of the washing container of a dishwasher with a filter assembly for cleaning circulated washing liquid, heated washing liquid circulated by a circulation pump is applied to the interior of the washing container, the heated wash liquor collecting in the sump once it has flowed through the filter assembly.

To generate the start signal, a control device of the water-conducting household appliance is assigned a signal generating device, by means of which the start signal can be generated in various ways.

According to a particularly simple embodiment, the signal generating device can have a counter unit which, for example, when certain relevant events occur, increments by at least one count value and on reaching a limit counter status generates a start signal. Meaningful signal generation can occur when the counter unit increments as a function of the number of wash cycles performed and/or the temperature profile of preceding wash cycles and/or the level of soiling of the items to be washed. Generally speaking, all influencing variables which have an influence on the soiling of the hydraulic circuit of the water-conducting household appliance may be considered here. Alternatively by recording the volume of water which has flowed into the water-conducting household appliance, the selected program and consequently the temperature profile can be inferred.

For a more precise assessment of the level of soiling in the hydraulic circuit of the household appliance, preferably several of the aforementioned influencing variables can be recorded. Furthermore, different count values can be assigned to each of the recorded influencing variables. As a result the influencing variables can be weighted against each other according to their importance for the soiling of the device. For example, a wash cycle performed with a high-temperature program can be assigned a count value of 1. A wash cycle performed with a low-temperature program, in comparison, can be assigned a count value of 2, as reduced process temperatures accelerate the soiling of the household appliance.

The invention can be technically achieved particularly easily if the counter unit increases its counter status for each wash cycle performed by the FIG. 1 and the limit counter status is in the region of 1 to 5, particularly at 3. In this case, without taking other influencing variables such as the wash program temperature profile or the level of soiling of the items to be washed into consideration, only the number of wash cycles performed is recorded. For example, after three completed normal wash cycles the control device can perform a special cleaning cycle with the aid of the special cleaning program.

Alternatively, or in addition to the counter unit, the signal generating device can have a soiling sensor, for instance a deposit sensor, which can record greasy films of dirt in areas prone to soiling of the water-conducting household appliance. In the case of the dishwasher, such areas prone to dirt are the base area of the washing container or the sump area in which the soiling sensor can be arranged, for instance. If a limit level of soiling is exceeded, a start signal can be generated by means of the soiling sensor. Alternatively, formation of a deposit may also be detected through the filter density. The loading of the electric motor driving the recirculation pump is recorded and evaluated for this purpose.

Unlike the aforementioned counter unit, a closed control loop exists here with the soiling sensor and the control device.

Usually the water-conducting household appliance may have different wash programs which can be selected by the user. In the case of a dishwasher, for example, these are a low-temperature program in which the washing liquid can be heated to somewhere in the region of 50° C., a normal program with washing liquid temperatures in the order of up to 65° C., and a high-temperature program in which washing liquid temperatures can rise to approx. 70° C. Preferably the special cleaning program can be identical to the high-temperature program selectable by the user, as a result of which altogether the data requirement or storage time in the control device can be reduced.

According to the invention the control device can activate the special cleaning program automatically, in other words, without the involvement of the user. The control device can therefore perform an impending wash cycle with the special cleaning program regardless of a wash program selected by the user. When there is a start signal, the special cleaning program therefore takes priority over the wash program selected by the user and runs automatically in the background.

As aforementioned, in the special cleaning cycle washing liquid is applied to at least the areas prone to soiling of the water-conducting household appliance, the temperature of which is hot enough to remove the grease deposits or films of dirt. A washing liquid temperature on a scale which permits the breakdown of grease is preferred, in other words somewhere in the region of 65 to 70° C.

The special cleaning program may therefore differ from a normal cleaning program as a result of substantially higher process temperatures in at least one or more subprogram sections.

The special cleaning program may, however, also differ with regard to a flow guide for the washing liquid in the hydraulic circuit compared to a normal wash program. In the case of a dishwasher as is known at the start of a cleaning program step both a detergent is added to the washing liquid as well as the washing liquid is heated to a high cleaning temperature. The cleaning temperature is selected such that a mixing temperature in the order of 50° C. is normally produced in the dishwasher interior of the washing container. This mixing temperature is produced by the temperature of the items to be washed, the temperature of the washing liquid and the temperature of the washing container.

In comparison, in a preferred process control in the special cleaning program, in particular during the heating phase up to the cleaning temperature, an upper spray plane can be put out of operation. In this way the entire hydraulic circuit only operates via a lower spray plane close to the base of the washing container. The items to be washed in the upper spray plane are therefore not included in the hydraulic circuit during the heating phase. Accordingly, the upper items to be washed do not contribute to a reduction in the temperature of the washing liquid, as a result of which the mixing temperature produced near the base of the washing container is increased, namely in comparison with a mixing temperature produced in a normal wash program.

Alternatively and/or in addition, a higher hydraulic or mechanical removal rate on one or more spray planes can also be achieved by increasing the speed of the circulation pump. At higher circulation pump speeds the volume of washing liquid must be adjusted accordingly.

On the one hand, for instance, a so-called gentle wash or glass program, which operates at reduced process temperatures, is to be understood by the aforementioned low-temperature program. In addition, a wash program in the sense of the invention is also to be understood by a low-temperature program, as may be used in a dishwasher with an external drying system.

In such a dishwasher during the drying phase the moisture-laden air is fed from the dishwasher interior e.g. into an external sorption column with zeolite material, in which moisture is extracted from the air. The air dried in this way is then returned to the dishwasher interior.

With such an external drying process, heating the washing liquid to approx. 60 to 70° C. in the upstream rinsing step ceases to apply. Such heating of the washing liquid in the rinsing step is known to support the drying of items to be washed in accordance with the condensation principle. In contrast, in a dishwasher with an external drying system the washing liquid is not heated during the rinsing step but a mixing temperature in the order of approx. 30° C. is produced on account of the heat of the items to be washed themselves.

BRIEF DESCRIPTION OF THE DRAWINGS

Below two exemplary embodiments of the invention are described with the aid of the appended figures.

The figures show.

DETAILED DESCRIPTION OF EXEMPLARY EMBODIMENTS OF THE PRESENT INVENTION

Figure 1:
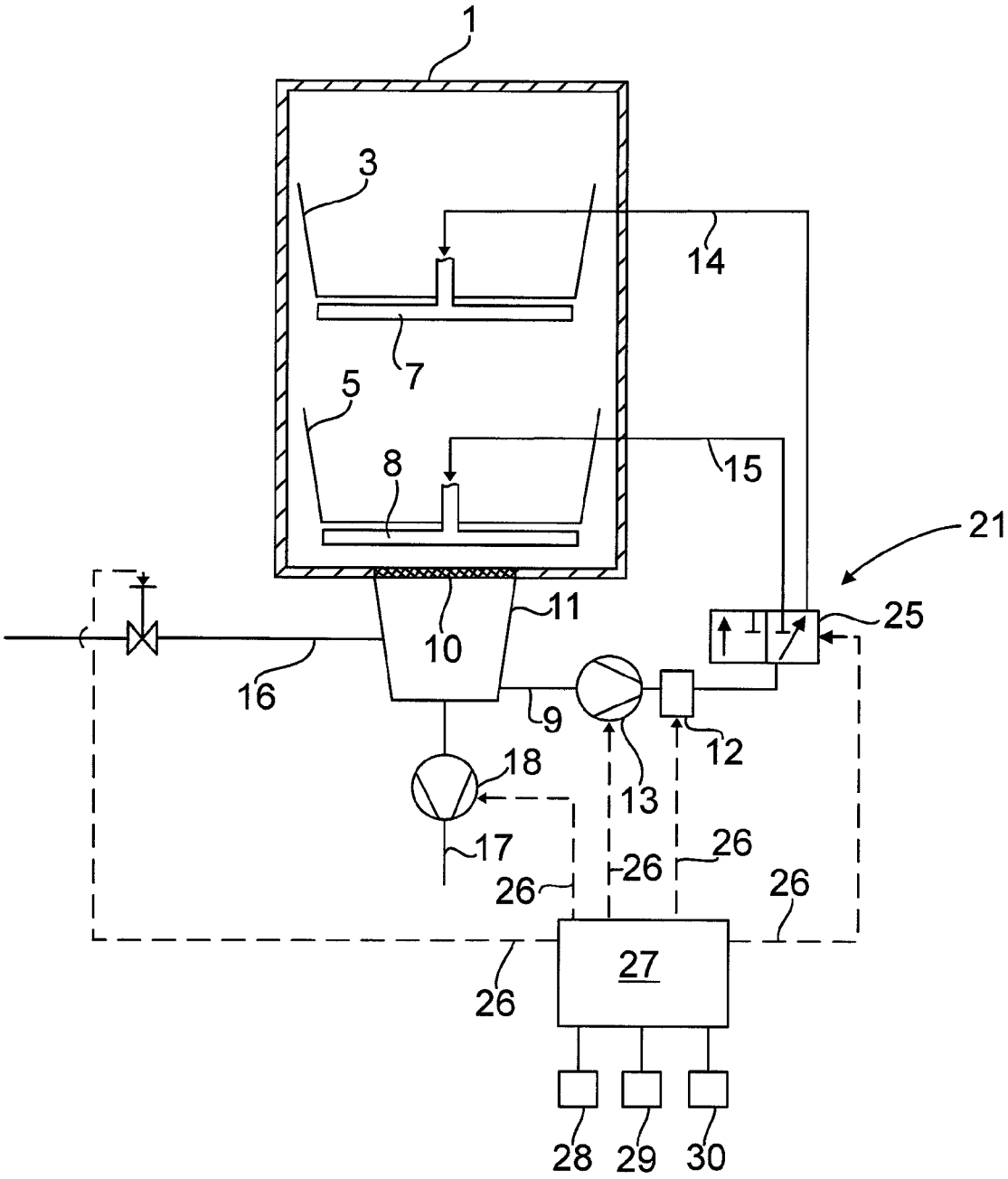
FIG. 1 in a schematic block diagram a dishwasher for performance of the washing method according to the invention.

FIG. 1 is a schematic illustration of a dishwasher as an exemplary embodiment of a water-conducting household appliance with a washing container 1 adjacent to a dishwasher interior. In the dishwasher interior of the washing container 1 items to be cleaned, not shown, can be arranged in dish racks 3, 5. In the washing container 1 shown, for example, two spray arms 7, 8 on different spray planes are arranged, via which washing liquid is applied to the items to be washed. In the washing container base there is a sump 11 with an only approximately indicated filter arrangement 10. A circulation line 9 with a circulation pump 13 arranged therein is guided away from the sump 11.

The circulation line 9 is fluidically connected to the spray arms 7, 8 via supply lines 14, 15. Downstream of the circulation pump 13 is a heating element 12 designated as a water heater, for instance a continuous-flow heater.

Furthermore, a fresh-water supply line 16 and a drain line 17 are connected to the sump 11, in which a drain pump 18 for pumping washing liquid out of the washing container 1 is arranged.

Downstream of the heating element 12 a branching point 21 is provided in the circulation line 9, at which the two supply lines 14, 15 branch off. At the branching point 21 there is an alternative water distributor designed as a three-way control valve 25. The alternative water distributor 25 connects the circulation line 9 in its switch position shown in FIG. 1 to the supply line 14. In the second switch position, not shown, of the alternative water distributor 25, the circulation line 9 is connected to the supply line 15 and the supply line 14 is decoupled from the hydraulic circuit. By means of corresponding shift activation during the wash cycle, alternating operation can therefore take place, in which the washing liquid is applied via the upper or lower spray arm 7, 8 to the items to be washed or the washing container side walls.

The program runs illustrated in the temperature-time diagram show the individual subprogram steps of a wash cycle, namely prewashing V, cleaning R, intermediate washing Z, rinsing K and drying T. These subprogram steps are performed by means of a control device 27 which is connected via signal lines 26, shown by a dotted line, to the respective device components.

In addition, three actuating elements 28, 29, 30 are assigned to the control device 27. By means of the actuating elements 28, 29, 30 the user can select whether the control device 27 should perform a wash cycle with a low-temperature program I, a normal program II or a high-temperature program III.

Figure 2:
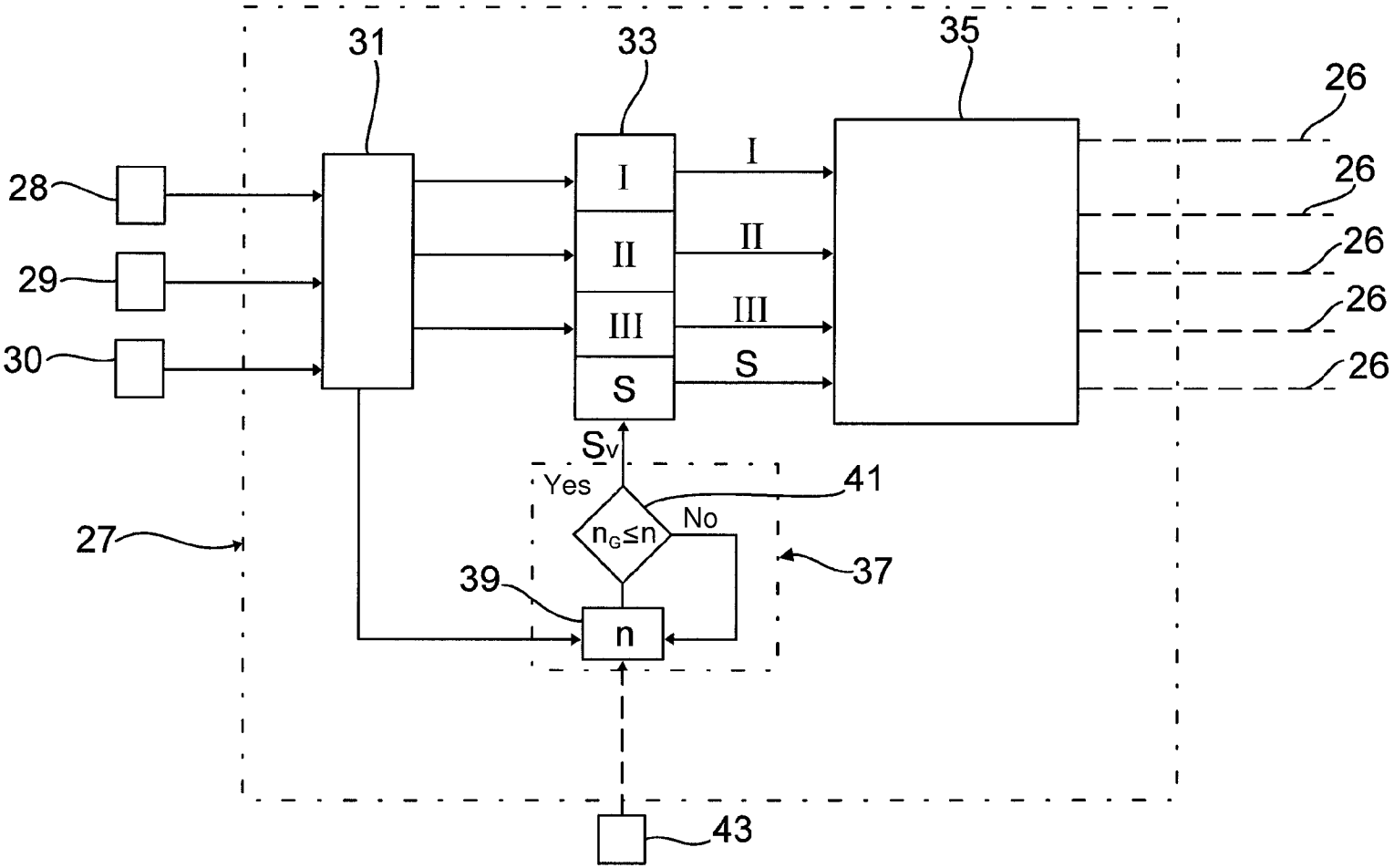
FIG. 2 in a detailed view the control device of the dishwasher in accordance with the first exemplary embodiment.

In FIG. 2 the control device 27 is shown in accordance with the first exemplary embodiment as a block diagram. The control device 27 has an input unit 31, which in signal connections with the actuating elements 28, 29, 30 is for selection of the wash program. Besides the input unit 31, a storage unit 33 is provided in which the low-temperature program I, the normal program II and the high-temperature program III are stored. Furthermore, a special wash program S is stored in the storage unit 33. The storage unit 33 is in signal connection with a control unit 35, which after starting the dishwasher performs the wash cycle by means of one of the wash programs I, II, III or S.

In accordance with FIG. 2, in addition the control device 27 has a signal generating device 37 which in the event of a soiling in the hydraulic circuit of the dishwasher generates a start signal $S_V$ and transmits it to the storage unit 33. In this exemplary embodiment the signal generating device 37 has a counter unit 39 and a downstream comparison unit 41. The comparison unit 41 transmits the start signal $S_V$ to the storage unit 33, provided that a counter status n of the counter unit 39 reaches a specified limit counter status $n_G$.

In an embodiment which is technically particularly easy to achieve, the counter unit 39 is only in signal connection with the input unit 31. The counter unit 39 increases its counter status n by the figure "1" for every wash cycle performed. The limit counter status $n_G$ may, for example, be 3. This means that the comparison unit 41 generates the start signal $S_V$ every third wash cycle.

When there is a start signal $S_V$, regardless of the wash program I, II or III selected by the user, the special cleaning program S is stored in the control unit 35. Therefore, without special selection by the customer, a special cleaning cycle is started which may differ compared to a wash program which can be selected by the user with regard to process temperatures and/or the flow guide or flow rate of the washing liquid.

Besides the number of wash cycles performed, the formation of films of dirt depends on additional factors, for instance the temperature profile of the respective wash program I, II, III used to perform the wash cycles or the level of soiling of the items to be washed.

In accordance with a modification of the first exemplary embodiment, the counter status n in the counter unit 39 can be increased not only as a function of the number of wash cycles already performed but also as a function of the aforementioned additional influencing variables. According to FIG. 2, a soiling sensor 43 detecting, for example, the level of soiling of the items to be cleaned can be provided. If the detected level of soiling exceeds a limit value, the counter status n of the counter unit 39 can be increased by an initial count value. Likewise, after the performance of a wash cycle, the counter status n of the counter unit 39 can be increased by a second count value.

In the aforementioned modification, when increasing the counter status n of the counter unit both the influencing variable "Number of wash cycles" and the influencing variable "Level of soiling of the items to be washed" are taken into account. The first and second count values may be different, resulting in both the influencing variables being weighted.

For example, a device cleaning method with a limit counter status $n_G$ of 3 is explained in the following. Only the number of wash cycles already performed should be recorded by the counter unit 39 without in addition also recording the type of wash program used, in other words, low-temperature program I, normal program II or high-temperature program, or other influencing variables.

Thus, for a first wash cycle the user selects the low-temperature program I using the actuating element 28 and stores it in the control unit 35, which performs the wash cycle with the low-temperature program I. At the same time the counter status n in the counter unit is moved from 0 to 1. In the subsequent wash cycle the user can, for example, select the normal program II by means of the actuating element 29. The counter unit 39 therefore increases its counter status n from 1 to 2. At the same time the storage unit 33 stores the normal program II in the control unit II in the control unit 35 so that the wash cycle takes place as a result of the normal program II selected by the user.

For a subsequent third wash cycle the user may select the high-temperature program III. The counter unit 39 therefore increases its counter status n from 2 to 3, as a result of which the comparison unit 41 generates the start signal $S_V$ and transmits it to the storage unit 33. In this case, the storage unit 33 does not store the high-temperature program III selected by the user in the control unit 35 but instead of this the special cleaning program S. The third wash cycle therefore takes place—without special selection by the user—by means of the special cleaning program S.

Figure 3:
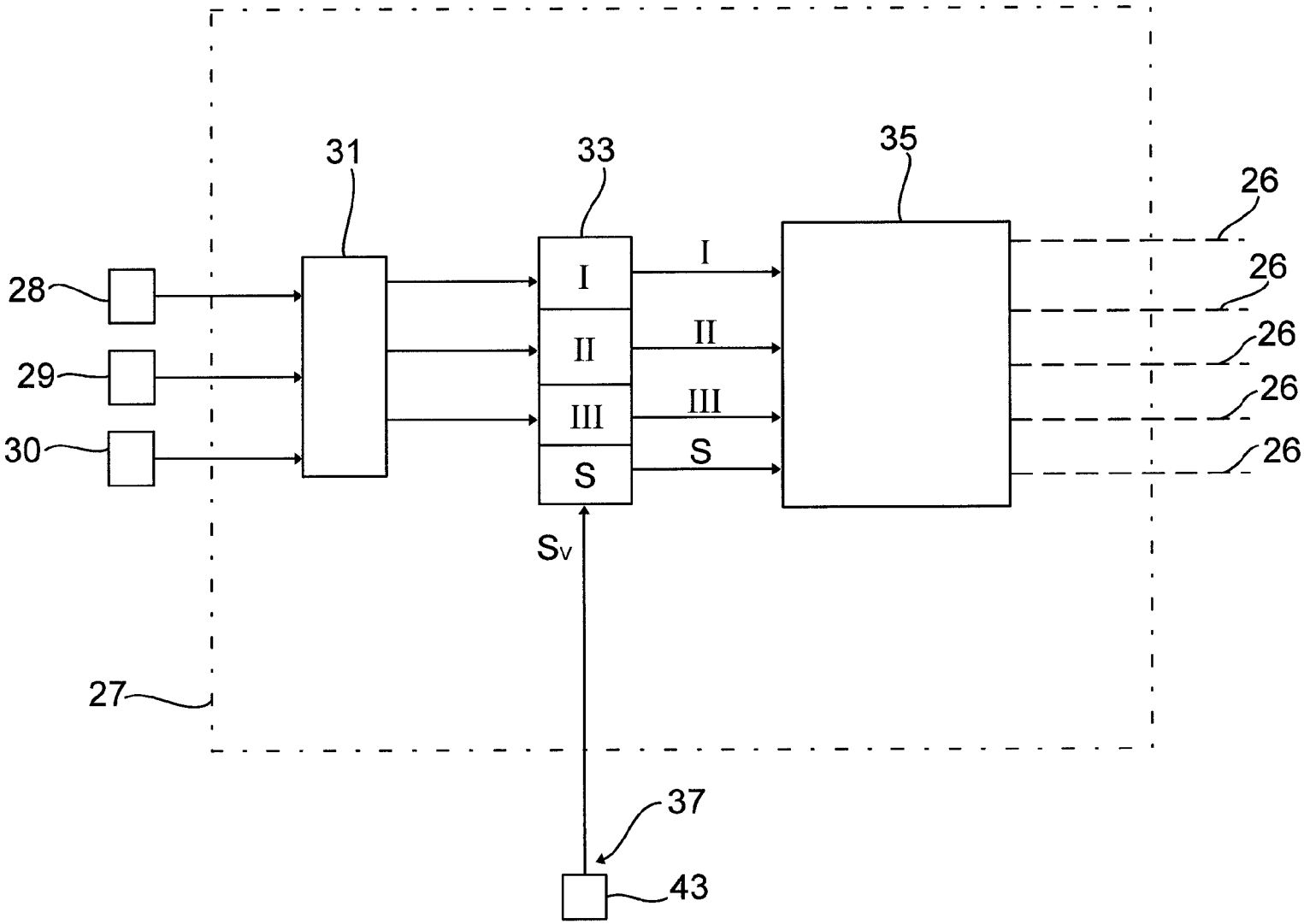
FIG. 3 in a view corresponding to FIG. 2 the control device as per the second exemplary embodiment.

In FIG. 3 the control device 27 according to the second exemplary embodiment is shown as an alternative to FIG. 2. The control device 27 according to FIG. 3 corresponds with regard to design and operation to the control device 27 of the first exemplary embodiment. In this respect reference is made to its description.

However, the control device 27 of the second exemplary embodiment has a differently implemented signal generating device 37. This is not equipped with a counter unit but only has the soiling sensor 43 which, for example, is provided as a deposit sensor for detecting greasy films of dirt in the base area of the washing container prone to soiling. The deposit sensor 43 together with the control unit 35 is integrated in a closed control loop in which the deposit sensor 43 detects an actual start signal and transmits it to the comparison unit 41. In the comparison unit 41 the detected actual start signal is compared to a limit value and if the limit value is exceeded, the start signal $S_V$ is generated and transmitted to the storage unit 33.

The control loop records the actual level of soiling in the hydraulic circuit of the dishwasher.

Figure 4:
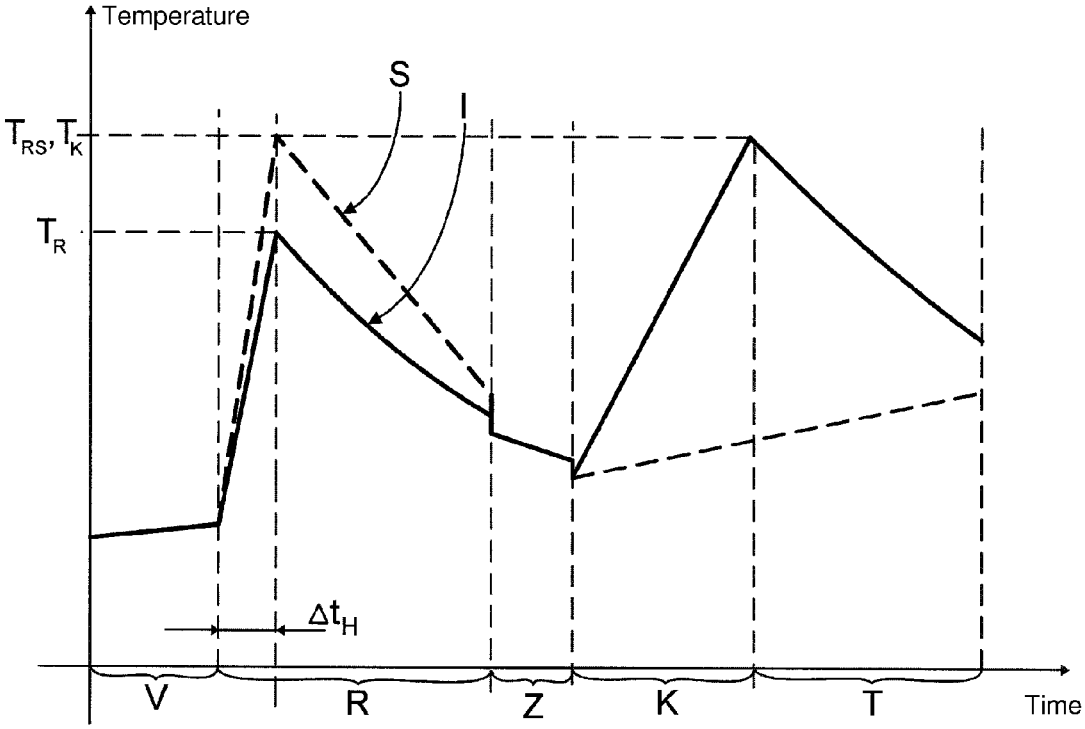
FIG. 4 a temperature-time diagram, in which a normal wash program and a special cleaning program is shown.

The temperature-time diagram in FIG. 4 shows the program sequence of the low-temperature program I and the special cleaning program S. The low-temperature program I corresponds to a traditional dishwasher program in which after prewashing has finished at the start of cleaning step R the washing liquid temperature is increased to the cleaning temperature $T_R$ by means of the water heater 12. The cleaning temperature $T_R$ is in the region of 50° C. In the following wash cycle the temperature of the washing liquid cools down again. During the rinsing phase K, the temperature of the washing liquid is once again heated by means of the water heater 12 to the rinsing temperature $T_K$, which is in the region of 65° C. and is supported by the subsequent drying process T. The drying process can—as per the solid line—take place according to the known condensation principle, in which the moisture-laden air condenses on the side walls of the washing container. Alternatively—as per the dotted line—an external drying system, for instance a sorption column, can be provided in which the air to be dried is guided from the washing container 1 into the external sorption column and dehumidified there. In this way, heating the washing liquid during the rinsing phase K can be avoided.

When performing the special cleaning program S, in contrast to the low-temperature program I shown, the temperature of the washing liquid is increased to a cleaning temperature $T_{RS}$, which is in a range between 65 and 75° C. In this way, the increased cleaning temperature $T_{RS}$ enables the breakdown of collected films of dirt during the circulation loop and their removal from the areas of the hydraulic circuit of the dishwasher prone to soiling. Alternatively and/or in addition to the increased cleaning temperature $T_{RS}$ during the heating phase $\Delta t_H$ in the special cleaning program S, the upper spray arm 7 can be put out of operation. To this end the alternative water distributor 25 as per FIG. 1 is moved into the second switch position, not shown, in which the flow connection to the upper spray arm 7 is interrupted. In this way, the entire hydraulic circuit takes place only via the lower spray arm 8, which only applies washing liquid to the base area and the items to be washed provided in the lower dish rack 5. As a result of this special application of washing liquid, the mixing temperature produced near the washing container base increases in comparison to a normal wash program.

LIST OF REFERENCE CHARACTERS

1 Washing container
3 Dish rack
5 Dish rack
7 Spray arm
8 Spray arm
9 Circulation line
10 Filter arrangement
11 Sump
12 Heating element
13 Circulation pump
14 Supply line
15 Supply line
16 Fresh-water supply line
17 Drain line
18 Drain pump
21 Branching point
25 Three-way control valve
26 Signal line
27 Control device
28 Actuating element
29 Actuating element
30 Actuating element
31 Input unit
33 Storage unit
35 Control unit
37 Signal generating device
39 Counter unit
41 Comparison unit
43 Soiling sensor
I Low-temperature program
II Normal program
III High-temperature program
n Counter status
$n_G$ Limit counter status
V Prewashing
R Cleaning
T Drying
Z Intermediate washing
K Rinsing
$\Delta t_H$ Heating step
$T_K$ Rinsing temperature
$T_R$ Cleaning temperature
$T_{RS}$ Cleaning temperature
$S_V$ Start signal

The invention claimed is:

1. A water-conducting household appliance comprising:

a washing container;

a control device configured to separately carry out a user-selected wash program and a special cleaning program adapted to clean the washing container, the control device assigning a higher priority to the special cleaning program than the user-selected wash program; and a washing liquid source configured to supply the washing container with a washing liquid, wherein the control device is configured to carry out a wash cycle according to the special cleaning program in response to a start signal generated without user input.

2. The water-conducting household appliance of claim 1, wherein the water-conducting household appliance is one of a dishwasher and a washing machine; wherein the user-selected wash program is a low-temperature program; and wherein the washing container is cleaned by applying washing liquid to the washing container.

3. The water-conducting household appliance of claim 1 further comprising a signal generating device connected to the control device, the signal generating device being configured to generate the start signal.

4. The water-conducting household appliance of claim 3, wherein the signal generating device has a counter unit configured to generate the start signal upon reaching a limit counter status.

5. The water-conducting household appliance of claim 4, wherein the counter unit is configured to increment as a function of at least one recorded influencing variable that influences the level of soiling of the household appliance.

6. The water-conducting household appliance of claim 5, wherein, the control device is configured to detect the at least one recorded influencing variable, the at least one recorded influencing variable comprising at least one of (1) the number of wash cycles performed, (2) a temperature profile of the user-selected wash program used in previous wash cycles, and (3) the level of soiling of items to be washed.

7. The water-conducting household appliance of claim 3, wherein the signal generating device has a soiling sensor configured to generate the start signal when a limit level of soiling is exceeded.

8. The water-conducting household appliance of claim 7, wherein the soiling sensor is a deposit sensor.

9. The water-conducting household appliance of claim 8, wherein the deposit sensor is arranged in a hydraulic circuit of the water-conducting household appliance.

10. The water-conducting household appliance of claim 1, wherein at least one wash program is stored in the control device, the at least one wash program comprising at least one of a low-temperature wash program, a normal wash program and a high-temperature wash program, the user-selected wash program corresponding to one of the at least one wash program stored in the control device.

11. The water-conducting household appliance of claim 10, wherein the special cleaning program is identical to the high-temperature wash program.

12. The water-conducting household appliance of claim 4, wherein at least one of:

the counter unit is configured to increase a counter status for each wash cycle performed by a count value of "1"; and the limit counter status lies within a range of 1 to 5.

13. The water-conducting household appliance of claim 12, wherein the limit counter status is at 3.

14. The water-conducting household appliance of claim 6, wherein, for weighting the at least one recorded influencing variable, the control device assigns a respectively different count value to the at least one recorded influencing variable.

15. The water-conducting household appliance of claim 1, wherein, in the special cleaning program, the washing liquid is applied at least to areas of the water-conducting household appliance prone to soiling, and wherein the temperature of the washing liquid is sufficiently high to remove grease deposits.

16. The water-conducting household appliance of claim 15, wherein the temperature of the washing liquid lies within a range of 65 to 75° C.

17. The water-conducting household appliance of claim 1, wherein the water-conducting household appliance is a dishwasher and a heating phase subprogram step of the special cleaning program is configured to heat the washing liquid to a cleaning temperature and disable an upper spray plane so that an entire hydraulic circuit operates via a lower spray plane.

18. The water-conducting household appliance of claim 1, wherein the special cleaning program is configured to operate a circulation pump connected to a hydraulic circuit at higher speed.

19. The water-conducting household appliance of claim 10, wherein the control device is configured to carry out the special cleaning program when the start signal is generated regardless of whether one of the at least one wash program stored in the control device is selected by a user.

20. The water-conducting household appliance of claim 1, wherein the start signal is generated based on a condition of the washing container.

21. The water-conducting household appliance of claim 1, wherein the washing container is configured to hold items to be washed and the user-selected wash program is adapted to clean the items to be washed.

22. The water-conducting household appliance of claim 1, wherein the washing liquid source is configured to supply the same type of washing liquid to the washing container during the performance of the user-selected wash program and the special cleaning program.

23. A water-conducting household appliance comprising:

a washing container configured to hold items to be washed;

a control device configured to carry out a wash cycle according to one of a special cleaning program adapted to clean the washing container and a user-selected wash program adapted to clean the items to be washed; and a washing liquid source configured to supply the washing container with a washing liquid during performance of the wash cycle, wherein the control device is configured to carry out the wash cycle according to the special cleaning program instead of the user-selected wash program in response to a start signal generated without user input.

24. The water-conducting household appliance of claim 23, wherein the special cleaning program is configured to supply the washing liquid at a higher temperature than the user-selected wash program.

25. The water-conducting household appliance of claim 24, wherein the special cleaning program is configured to supply the washing liquid at a greater flow rate than the user-selected wash program.

26. The water-conducting household appliance of claim 25 further comprising a hydraulic circuit with an upper spray plane and a lower spray plane, wherein the user-selected wash program is configured to direct the washing liquid through the upper spray plane and the lower spray plane, and wherein the special cleaning program is configured to disable the upper spray plane.

27. The water-conducting household appliance of claim 23, wherein at least one of a low-temperature wash program, a medium-temperature wash program and a high-temperature wash program is stored in the control device, and wherein the user-selected wash program corresponds to one of the wash programs stored in the control device.

28. The water-conducting household appliance of claim 27 further comprising a signal generating device connected to the control device, the signal generating device being configured to generate the start signal.

29. The water-conducting household appliance of claim 28, wherein the signal generating device has a counter unit configured to generate the start signal upon reaching a limit counter status.

30. The water-conducting household appliance of claim 29, wherein the counter unit is configured to increment as a function of at least one recorded influencing variable that influences the level of soiling of the household appliance.

31. The water-conducting household appliance of claim 30, wherein, the control device is configured to detect the at least one recorded influencing variable, the at least one recorded influencing variable comprising at least one of (1) the number of wash cycles performed, (2) a temperature profile of the user-selected wash program used in previous wash cycles, and (3) the level of soiling of items to be washed.

32. The water-conducting household appliance of claim 31, wherein the signal generating device has a soiling sensor configured to generate the start signal when a limit level of soiling is exceeded.

33. The water-conducting household appliance of claim 32, wherein the soiling sensor is a deposit sensor.

34. The water-conducting household appliance of claim 33, wherein the deposit sensor is arranged in a hydraulic circuit of the water-conducting household appliance.

* * * * *